US011150597B1

(12) United States Patent
Anzai et al.

(10) Patent No.: US 11,150,597 B1
(45) Date of Patent: Oct. 19, 2021

(54) POWDER PROCESSING APPARATUS

(71) Applicant: FUJIFILM Business Innovation Corp., Tokyo (JP)

(72) Inventors: Takashi Anzai, Kanagawa (JP); Takahiro Kimura, Kanagawa (JP); Kazuaki Iikura, Kanagawa (JP); Tetsuji Okamoto, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 16/983,430

(22) Filed: Aug. 3, 2020

(30) Foreign Application Priority Data

Mar. 26, 2020 (JP) ..... JP2020-055416

(51) Int. Cl.

| | |
|---|---|
| ***G03G 21/16*** | (2006.01) |
| ***G03G 15/08*** | (2006.01) |
| ***G03G 21/12*** | (2006.01) |
| ***G03G 21/10*** | (2006.01) |

(52) U.S. Cl.
CPC ..... *G03G 21/1633* (2013.01); *G03G 15/0865* (2013.01); *G03G 21/105* (2013.01); *G03G 21/12* (2013.01)

(58) Field of Classification Search
CPC ..... G03G 15/0865; G03G 15/0875; G03G 21/10; G03G 21/105; G03G 21/12; G03G 21/1633
See application file for complete search history.

(56) References Cited

U.S. PATENT DOCUMENTS

| | | | | |
|---|---|---|---|---|
| 2005/0008393 | A1* | 1/2005 | Kuma | G03G 21/1633 399/110 |
| 2007/0048009 | A1* | 3/2007 | Izumi | G03G 15/0875 399/119 |
| 2008/0226339 | A1* | 9/2008 | Sato | G03G 15/0893 399/114 |
| 2010/0322666 | A1* | 12/2010 | Inomata | G03G 15/0886 399/120 |
| 2011/0182615 | A1* | 7/2011 | Morishita | G03G 15/0121 399/111 |

(Continued)

FOREIGN PATENT DOCUMENTS

| | | |
|---|---|---|
| JP | 4434309 B1 | 3/2010 |
| JP | 2015-064598 A | 4/2015 |

*Primary Examiner* — Carla J Therrien
(74) *Attorney, Agent, or Firm* — Sughrue Mion, PLLC

(57) ABSTRACT

A powder processing apparatus includes a processing engine, a carrying region forming unit, a door, a powder storage unit. The processing engine is mounted inside an apparatus housing. The processing engine includes one or plural processing units each at least including a movable powder carrier that carries powder, and a powder supply unit. The carrying region forming unit forms a region in the powder carrier where powder can be carried. The door opens and closes an opening formed in a side wall of the apparatus housing. The powder storage unit stores the powder. The powder storage unit moves along with the opening and closing of the door. When the door is opened, an insertion and extraction path that is wide enough to insert and extract the processing engine is ensured in the opening, excluding a region blocked by the powder storage unit that moves along with the door.

20 Claims, 15 Drawing Sheets

(56) References Cited

U.S. PATENT DOCUMENTS

2012/0163858 A1* 6/2012 Fujii ..... G03G 21/1842
399/110
2015/0277293 A1* 10/2015 Maehara ..... G03G 15/0891
399/258

* cited by examiner

POWDER PROCESSING APPARATUS

CROSS-REFERENCE TO RELATED APPLICATIONS

This application is based on and claims priority under 35 USC 119 from Japanese Patent Application No. 2020-055416 filed Mar. 26, 2020.

BACKGROUND

1. Technical Field

The present disclosure relates to a powder processing apparatus.

2. Related Art

In the related art, this type of a powder processing apparatus is known from, for example, JP-A-2015-064598 (detailed description of embodiments and FIG. 6) and JP-B-4434309 (detailed description of embodiments and FIG. 3).

JP-A-2015-064598 discloses an electrophotographic image forming apparatus in which an LED unit and a support member that supports the LED unit take an exposure position and a retreating position along with an operation of a door, and a guide is provided in the LED unit or the support member that supports the LED unit, to guide a process cartridge.

JP-B-4434309 discloses an image forming apparatus in which a replenishment path forming member is supported at one side of a developing container.

SUMMARY

Aspects of non-limiting embodiments of the present disclosure relate to simply and easily implementing an attachment and detachment operation of a processing engine to and from an apparatus housing while downsizing the apparatus housing in an aspect where the processing engine for enabling a replenishment or collection of powder is mounted, as compared with a case where a powder replenishment or collection element is fixed inside the apparatus housing.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a powder processing apparatus including a processing engine, a carrying region forming unit, an opening and closing door, a powder storage unit. The processing engine is mounted inside an apparatus housing. The processing engine includes one or plural processing units. Each processing unit at least includes a movable powder carrier that carries powder, and a powder supply unit that supplies powder to the powder carrier. The carrying region forming unit forms a region in the powder carrier where powder can be carried. The opening and closing door opens and closes an opening about a rotation fulcrum. The opening is formed in a side wall of the apparatus housing disposed in one of directions intersecting a movement direction of the powder carrier. The powder storage unit stores the powder to be used or already used in the processing units. The powder storage unit is provided on the opening and closing door so as to move along with the opening and closing of the opening and closing door. When the opening and closing door is opened, an insertion and extraction path that is wide enough to insert and extract the processing engine is ensured in the opening of the opening and closing door, excluding a region blocked by the powder storage unit that moves along with the opening and closing door.

BRIEF DESCRIPTION OF THE DRAWINGS

Exemplary embodiment(s) of the present disclosure will be described in detail based on the following figures, wherein.

DETAILED DESCRIPTION

Outline of Exemplary Embodiments

Figure 1B:
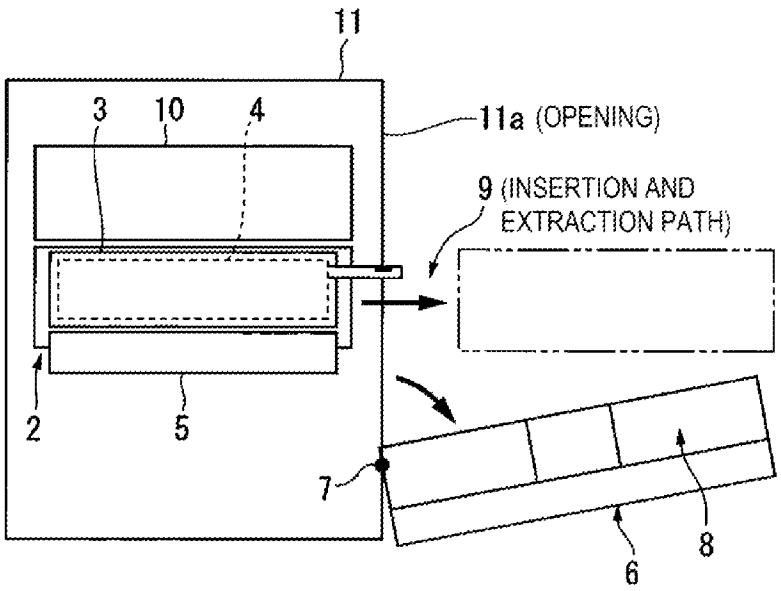
FIG. 1B is a view illustrating a status of an attachment and detachment operation of a processing engine when an opening and closing door is opened.
Figure 1A:
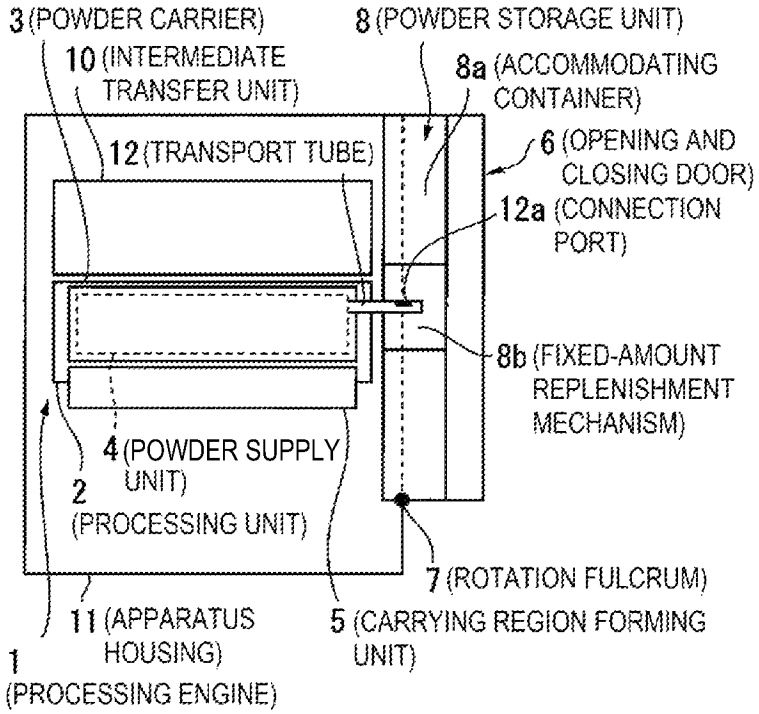
FIG. 1A is a view illustrating an outline of an exemplary embodiment of a powder processing apparatus to which the present disclosure is applied.

FIG. 1A is a view illustrating an outline of an exemplary embodiment of a powder processing apparatus to which the present disclosure is applied.

In FIG. 1A, the powder processing apparatus includes: a processing engine 1 mounted inside an apparatus housing 11 and provided with one or plural of processing units 2 each at least including a movable powder carrier 3 that carries powder and a powder supply unit 4 that supplies the powder to the powder carrier 3; a carrying region forming unit 5 that forms a region in the powder carrier 3 where the powder can be carried; an opening and closing door 6 that opens and closes an opening 11*a* (see FIG. 1B) about a rotation fulcrum 7, the opening 11*a* being formed in a side wall of the apparatus housing 11 in one of directions orthogonal to the movement direction of the powder carrier 3; and a powder storage unit 8 that stores powder to be used or already used in the processing unit 2, the powder storage unit 8 being disposed on the opening and closing door 6 so as to move along with the opening and closing of the opening and closing door 6. As illustrated in FIG. 1B, when the opening and closing door 6 is opened, an insertion and extraction path 9 which is wide enough to insert and extract the processing engine 1 is ensured in the opening 11*a* of the opening and closing door 6, excluding the region blocked by the powder storage unit 8 that moves along with the opening and closing door 6.

In this technical configuration, the processing engine 1 may include one or plural processing units 2, and each processing unit 2 may include the powder carrier 3 and the powder supply unit 4.

In addition, any unit may be appropriately selected as the carrying region forming unit 5 as long as the unit forms the region in the powder carrier 3 where the powder can be carried. The region where the powder can be carried may be a portion or the entire area of the powder carrier 3.

It is assumed that the opening and closing door 6 opens and closes the opening 11*a* formed in one side wall of the apparatus housing 11 in one of the directions intersecting the movement direction of the powder carrier 3. This configuration is necessary for inserting and extracting the processing engine 1 without the retreat of the carrying region forming unit 5.

Further, the powder storage unit 8 serves as both an element that replenishes new powder to the powder supply unit 4 and an element that collects used powder.

In addition, while the powder storage unit 8 provided in the opening and closing door 6 blocks a portion of the opening 11*a* when the opening and closing door 6 is opened, the other region of the opening 11*a* may have a size necessary for inserting and extracting the processing engine 1 or a relatively larger size so as to serve as the insertion and extraction path 9.

Next, a representative aspect of the powder processing apparatus according to the present exemplary embodiment will be described.

First, as for an example of the installation of the plural processing units 2 of the processing engine 1 from the viewpoint of reducing the height dimension of the apparatus housing 11, the plural processing units 2 may be arranged side by side in a substantially horizontal direction or a direction oblique to the horizontal direction.

As an aspect of the processing engine 1 provided with the plural processing units 2, all or a portion of the plural processing units 2 arranged side by side may be supported by a common engine frame. The present example relates to an aspect where the plural processing units 2 supported by the common engine frame may be collectively inserted and extracted.

As for a representative aspect of the powder storage unit 8, as illustrated in FIG. 1A, the powder storage unit 8 may include an accommodating container 8*a* that accommodates powder to be replenished to the processing units 2, and a fixed-amount replenishment mechanism 8*b* that replenishes the powder accommodated in the accommodating container 8*a* in a fixed amount. This configuration is an aspect for replenishing powder.

As for another representative aspect of the powder storage unit 8, the powder storage unit 8 may include a collection container (not illustrated in FIGS. 1A and 1B) that collects powder already used in the powder supply unit 4. This configuration is an aspect for collecting powder.

As for an aspect of the powder storage unit 8, each processing unit 2 of the processing engine 1 may include a transport tube 12 for replenishment or collection of powder, and a connection port 12*a* at an end portion of the transport tube 12 on the opening and closing door 6 side, and the powder storage unit 8 may have a connected port (not illustrated in FIGS. 1A and 1B) that can be connected to or disconnected from the connection port 12*a* of the transport tube 12 along with the opening and closing of the opening and closing door 6.

Here, as for an example of the layout of the connection port 12*a* and the connected port in the powder storage unit 8, the connection port 12*a* may be provided at a lower or upper portion of the transport tube 12, and the connected port (not illustrated) may face the connection port 12*a*.

As for a structure of the connection portion of the powder storage unit 8, shutter mechanisms may be provided on the connection port 12*a* and the connected port, respectively, the shutter mechanisms are opened when the connection port 12*a* and the connected port are connected to each other, and the shutter mechanisms are closed when the connection port 12*a* and the connected port are disconnected from each other. In particular, it is possible to effectively eliminate the concern of leakage of powder from the connection port 12*a* or the connected port, when the connection state with the transport tube 12 is released.

As for an aspect of the opening and closing door 6 from the viewpoint of stably opening and closing the powder storage unit 8 in consideration of the opening and closing operability of the opening and closing door 6, the opening and closing door 6 may have the rotation fulcrum 7 at the lower edge portion of the opening 11*a* of the apparatus housing 11.

As for an aspect of the rotation fulcrum 7 of the opening and closing door 6, each processing unit 2 of the processing engine 1 may include the transport tube 12 for replenishment or collection of powder, the transport tube 12 may have the connection port 12*a* at an end portion of the transport tube 12 on the opening and closing door 6 side, and the rotation fulcrum 7 of the opening and closing door 6 may be positioned on the substantially vertical line to the connection port 12*a*. Here, in an aspect where the rotation fulcrum 7 of the opening and closing door 6 is deviated from the substantially vertical line to the connection port 12*a* of the transport tube 12, it may be necessary to increase the dimension of the powder storage unit 8 in the direction along the transport tube 12 in order to ensure the connection state between the powder storage unit 8 and the transport tube 12, or research the structure of the powder storage unit 8 around the transport tube 12 in order to prevent the interference with the transport tube 12 when the rotation operation of the opening and closing door 6 is performed. However, the aspect of the present disclosure effectively eliminates these problems.

When the present disclosure is applied to an image forming apparatus which is an example of the powder processing apparatus, the processing engine 1 may be an image forming engine including one or plural image forming units that serve as the one or the plural processing units 2. Each image forming unit may at least includes (i) an image carrier that serves as the powder carrier 3 and carries an image, and (ii) a developing unit that serves as the powder supply unit 4 and visualizes an image carried by the image carrier with an image forming agent serving as to powder. The carrying region forming unit 5 may be an image writing tool that writes an image on the image carrier.

Here, as for an example of a representative aspect of the image forming apparatus, an intermediate transfer unit 10 may be provided above the image forming engine serving as the processing engine 1. The intermediate transfer unit 10 and the image forming engine can be separately inserted and extracted through the opening 11*a* of the opening and closing door 6.

Hereinafter, the present disclosure will be described in more detail based on exemplary embodiments illustrated in the accompanying drawings.

Exemplary Embodiment 1

Figure 2:
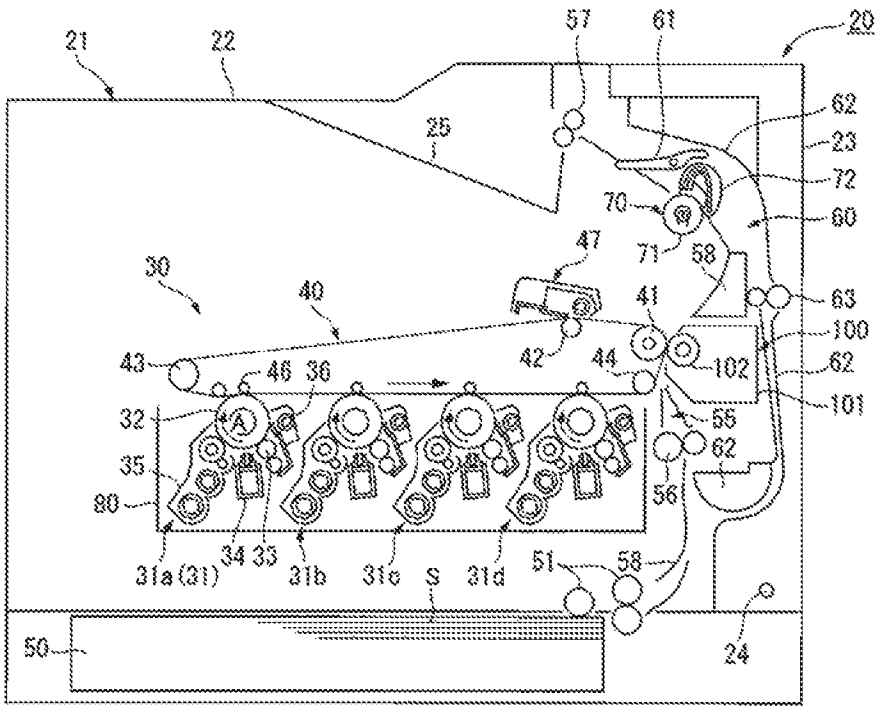
FIG. 2 is a view illustrating an entire configuration of an image forming apparatus which is an example of the powder processing apparatus according to Exemplary Embodiment 1.

FIG. 2 illustrates an example of the image forming apparatus which is the powder processing apparatus according to the present disclosure.

—Entire Configuration of Image Forming Apparatus—

In FIG. 2, an image forming apparatus 20 includes an image forming engine 30 as a processing engine capable of forming an image of each color component inside an apparatus housing 21. A sheet supply device 50 is provided below the image forming engine 30 inside the apparatus housing 21, to supply a sheet S as a recording medium. A transport path 55 is formed on one side surface of the apparatus housing 21, for example, on a rear surface side of the apparatus housing 21 (in this example, corresponding to the right side in FIG. 2), to transport the sheet S supplied from the sheet supply device 50 in the substantially vertical direction. A transfer device 100 is provided at the portion of the transport path 55 that faces the image forming engine 30, to transfer an image formed by the image forming engine 30 to the sheet S. A fixing device 70 is provided downstream of the transport path 55 from the transfer device 100 in the transport direction of the sheet S, to fix the image transferred to the sheet S.

—Image Forming Engine—

In the present exemplary embodiment, the image forming engine 30 includes plural image forming units 31 (specifically, 31*a* to 31*d*) that forms images in plural color components (four color components of yellow (Y), magenta (M), cyan (C), and black (K) in the present example) by, for example, an electrophotographic method, and for example, a belt-shaped intermediate transfer body 40 to which an image formed in each color component by each image forming unit 31 is primarily transferred before the image is transferred to the sheet S.

In the present exemplary example, each image forming unit 31 (31*a* to 31*d*) includes a drum-shaped rotatable photoconductor 32, a charging device 33 that charges the photoconductor 32 (a charging roller in the present example), a latent image writing device 34 that writes an electrostatic latent image on the charged photoconductor 32 (an LED writing head in the present example), a developing device 35 that develops the latent image formed on the photoconductor 32 with toner as powder, and a cleaning device 36 that cleans residues such as toner remaining on the photoconductor 32.

In the present example, each image forming unit 31 (31*a* to 31*d*) is mounted on a common engine frame 80, and the image forming engine 30 is collectively attached and detached with respect to the apparatus housing 21.

In the present example, the intermediate transfer body 40 is stretched over plural tension rollers 41 to 44 (five tension rollers in the present example), and is circularly rotated in the direction of the arrow in FIG. 2, using one of the tension rollers 41 to 44, for example, the tension roller 43 as a driving roller.

In the present example, the image forming units 31 are arranged side by side below the intermediate transfer body 40 in the substantially horizontal direction along the rotation direction of the intermediate transfer body 40. A primary transfer device 46 (a transfer roller in the present example) is provided at the position that faces the photoconductor 32 of each image forming unit 31, on the back surface of the intermediate transfer body 40, such that the image in each color component formed on each photoconductor 32 is electrostatically transferred one after another, to the intermediate transfer body 40.

In the present example, a transfer device 100 (corresponding to a secondary transfer device that secondarily transfers an image from the intermediate transfer body 40 to the sheet S) is provided at the portion of the intermediate transfer body 40 that faces the tension roller 41. Further, an intermediate transfer body cleaning device 47 is provided at the portion of the intermediate transfer body 40 that faces the tension roller 41, to clean residues such as toner and paper dust on the intermediate transfer body 40. The tension roller 44 is also used as a tension adjusting roller that adjusts the tension of the intermediate transfer body 40.

—Developing Device—

Figure 3:
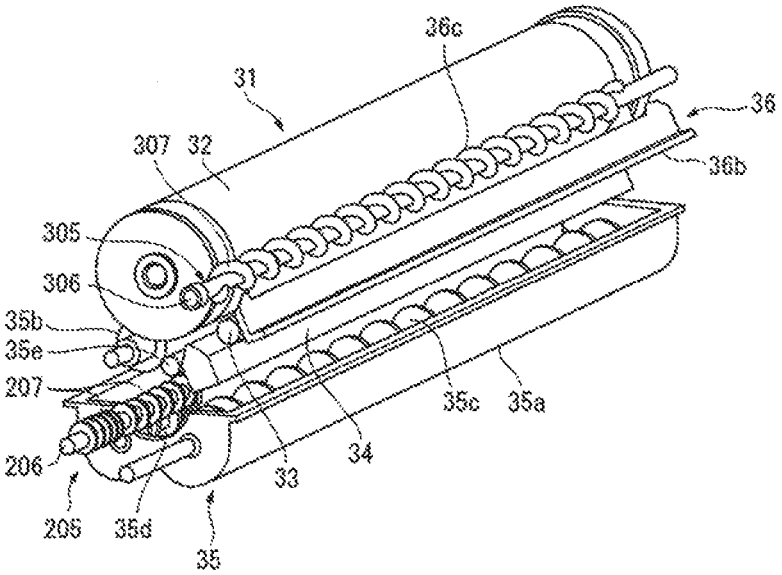
FIG. 3 is a view schematically illustrating each image forming unit of the image forming apparatus according to Exemplary Embodiment 1.

In the present example, as illustrated in FIG. 3, the developing device 35 includes a developing container 35*a* that is opened facing the photoconductor 32 and is able to accommodate a developer including toner and a carrier. A developing roller 35*b* (for example, a roller member provided with a cylindrical or columnar magnet roller of which magnetic poles are alternately changed in the circumferential direction, and a conductive sleeve disposed concentrically on the external side of the magnet roller) is disposed facing the opening of the developing container 35*a*. A developer is transported to the developing roller 35*b* while being carried thereon, such that the electrostatic latent image formed on the photoconductor 32 is developed with toner. Further, a pair of agitation transport members 35*c* and 35*d* (for example, an aspect where a spiral blade is attached around a rotary shaft) is disposed in the developing container 35*a*, so that the developer in the developing container 35*a* is uniformly charged and transported while being agitated. A supply roller 35*e* is disposed between the agitation transport member 35*c* and the developing roller 35*b* to supply the developer to the developing roller 35*b*.

—Cleaning Device—

In the present example, as illustrated in FIG. 3, the cleaning device 36 includes a cleaning container 36*a* (see FIGS. 9A and 9B) that is opened facing the photoconductor 32. A plate-shaped cleaning member 36*b* is mounted at the edge of the opening of the cleaning container 36*a*, and a leveling and transport member 36*c* that levels cleaned toner (for example, an aspect where a spiral blade is attached around a rotary shaft) is disposed inside the cleaning container 36*a*.

—Transfer Device (Secondary Transfer Device)—

In the present exemplary embodiment, the transfer device 100 functions as a secondary transfer device, and the secondary transfer device is basically configured by a secondary transfer unit 101 which is an integrated unit that includes a secondary transfer roller 102, as illustrated in FIG. 2. In the present example, a rear cover 23 is provided as an opening and closing door on the rear surface side of the apparatus housing 21, and is supported to be rotatable about a rotation fulcrum 24 formed at the lower portion of the rear surface of a housing body 22.

The secondary transfer unit 101 is mounted on the side of the rear cover 23, such that the secondary transfer unit 101 comes into contact with and is separated from the intermediate transfer body 40. When the rear cover 23 is closed, the secondary transfer roller 102 is disposed in contact with the intermediate transfer body 40, and a transfer electric field is formed between the secondary transfer roller 102 and the tension roller 41 that faces the secondary transfer roller 102, so that the image on the intermediate transfer body 40 is transferred to the sheet S. When the rear cover 23 is opened, the secondary transfer unit 101 moves together with the rear cover 23, and temporarily retreats from the contact position with the intermediate transfer body 40.

In the present example, the rear cover 23 is opened when the sheet S gets stuck (so-called jammed) in the transport path 55 or in a duplex transport path 60 to be described later, or when a maintenance or the like is necessary, so that the solution work of the paper jam or the maintenance work may be performed.

—Fixing Device—

In the present exemplary embodiment, the fixing device 70 includes a rotatable heating fixing member 71 (a heating fixing roller in the present example) of which surface temperature is heated to a predetermined temperature by a heater which is a heating source, and a pressurizing fixing member 72 (a pressurizing fixing belt in the present example) that rotates in contact with the heating fixing member 71 with a predetermined contact pressure along the axial direction of the heating fixing member 71. An unfixed image is fixed in the manner that the sheet S on which the unfixed image is carried passes through the contact region between the fixing members 71 and 72.

—Sheet Transport System—

In the sheet transport system of the present exemplary embodiment, the sheet S is delivered from a feeder 51 of the sheet supply device 50 to the transport path 55, the position of the sheet S is aligned at a position aligning roller 56 provided upstream of the transport path 55 from the secondary transfer region of the transfer device 100 in the transport direction of the sheet S, and then, the transfer process is performed by the transfer device 100. Further, the sheet S that has been subjected to the fixing process by the fixing device 70 is discharged from discharge rollers 57 toward a sheet accommodation tray 25 formed on the top of the apparatus housing 21. The reference numeral 58 refers to a partition member (a transport guide or the like) that partitions the transport path 55, and an appropriate number of transport members (transport rollers or the like) may be provided in the transport path 55 as necessary.

In the present exemplary embodiment, the duplex transport path 60 is formed between the fixing device 70 and the discharge rollers 57 in the transport path 55. The duplex transport path 60 branches from the transport path 55 and return to the upstream of the transport path 55 from the position aligning roller 56 in the transport direction of the sheet S. The duplex transport path 60 is used when a double-sided image forming mode (corresponding to a double-sided image forming method) is selected as an image forming mode which is an image forming method of the image forming apparatus 20. When the double-sided image forming mode is selected, an image forming process is performed on one page of the sheet S supplied from the sheet supply device 50. Then, the sheet S with an image formed on one page thereof is not discharged by the discharge rollers 57 to the sheet accommodation tray 25, and is once held in a state of being temporarily stopped at the discharge rollers 57. When the rotation direction of the discharge rollers 57 is reversed, the sheet S is transported toward the duplex transport path 60, and is turned back in the way that the front and back pages of the sheet S are reversed before the position aligning roller 56 of the transport path 55, such that the image forming process is performed on the other page of the sheet S with an image formed on one page thereof. Then, the sheet S with images formed on both pages thereof is discharged by the discharge rollers 57 to the sheet accommodation tray 25. The reference numeral 61 refers to a switching gate that switches and guides the sheet S with an image formed on one page thereof to the duplex transport path 60 when the sheet S is held in a state of being temporarily stopped at the discharge rollers 57, in a case where the double-sided image forming mode is selected. The reference numeral 62 refers to a partition member (a transport guide) that partitions the duplex transport path 60. The reference numeral 63 refers to an appropriate number of transport members (transport rollers in the present example) that transport the sheet S in the duplex transport path 60.

—Toner Transport System—

In each image forming unit 31 (31*a* to 31*d*) according to the present exemplary embodiment, as illustrated in FIGS. 3 to 6, the developing device 35 is provided with a replenished toner transport unit 200 that replenishes new toner, and the cleaning device 36 is provided with a collected toner transport unit 300 that collects cleaned waste toner.

<Replenished Toner Transport Unit>

In the present example, the replenished toner transport unit 200 is configured in the form that a tubular replenishment transport tube 201 is connected to and communicates with one end of the developing container 35*a* in the rotation axis direction of the developing roller 35*b*, and a toner transport member 205 (for example, an aspect where a spiral blade 207 is attached around a rotation shaft 206) is disposed inside the replenishment transport tube 201.

A replenishment connection port 210 is formed in the upper portion of the replenishment transport tube 201 near the protruding end thereof, and a tube-side replenishment shutter mechanism 220 is provided around the replenishment connection port 210.

<Tube-Side Replenishment Shutter Mechanism>

Figure 9B:
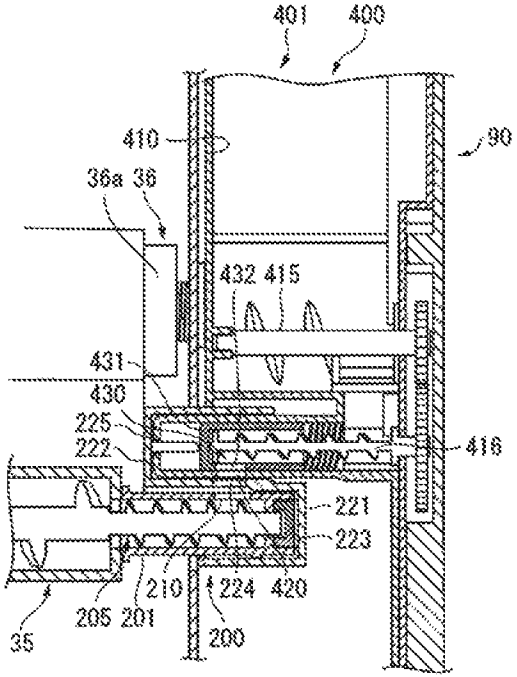
FIG. 9B is a view illustrating a state where the developing device and the toner supply unit are connected to each other.
Figure 9A:
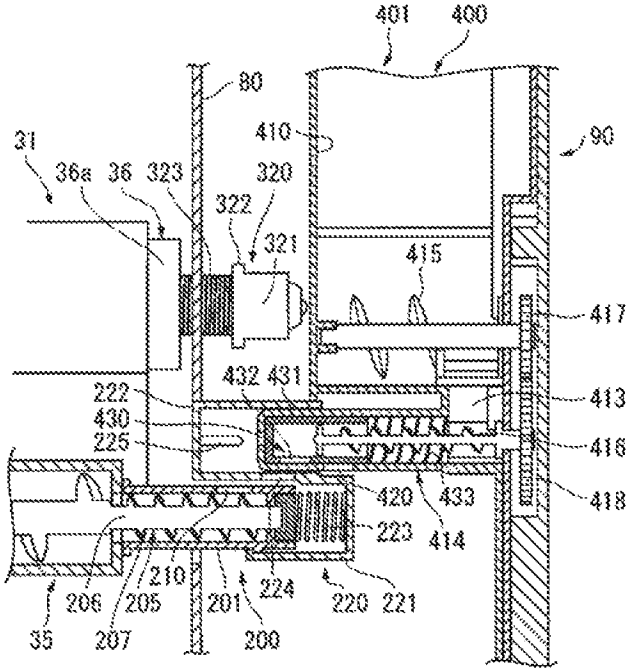
FIG. 9A is a view illustrating a state before a developing device of the image forming unit of the image forming engine and a toner supply unit of the toner cartridge are connected to each other.

In the present example, as illustrated in FIGS. 9A and 9B, the tube-side replenishment shutter mechanism 220 includes a lower tubular portion 221 that is slidable in a state of being fitted around the protruding end of the replenishment transport tube 201, and an upper tubular portion 222 that is formed to be integrated with the upper portion of the lower tubular portion 221.

Here, the lower tubular portion 221 is blocked by an end wall on the side of the protruding end of the replenishment transport tube 201, a biasing spring 223 is provided from the wall portion of the protruding end of the replenishment transport tube 201 inside the lower tubular portion 221, and a communication port 224 is formed between the lower tubular portion 221 and the upper tubular portion 222 to be opened in the vertical direction. Accordingly, the tube-side replenishment shutter mechanism 220 is moveable between an opened position where the tube-side replenishment shutter mechanism 220 moves along the longitudinal direction of the replenishment transport tube 201 against the biasing force of the biasing spring 223 such that the replenishment connection port 210 and the communication port 224 are connected to each other, and a closed position where the tube-side replenishment shutter mechanism 220 moves toward the developing device 35 from the opened position due to the biasing force of the biasing spring 223 such that the replenishment connection port 210 and the communication port 224 are deviated from each other.

In the present example, the upper tubular portion 222 is blocked by an end wall on the side of the developing device 35, and an operation pin 225 is formed on the inner end wall of the upper tubular portion 222 to protrude substantially in parallel with the protruding direction of the replenishment transport tube 201.

<Collected Toner Transport Unit>

The collected toner transport unit 300 is configured in the form that a tubular collection transport tube 301 is connected to and communicates with one end of the cleaning container 36*a* in the rotation axis direction of the leveling transport member 36*c* of the cleaning container 36*a*, and one end of the leveling transport member 36*c* extends inside the collection transport tube 301 to dispose the toner transport member 305 (for example, an aspect where a spiral blade 307 is attached around a rotary shaft 306).

A collection connection port 310 is formed in a lower portion of the collection transport tube 301 near the protruding end thereof, and the tube-side collection shutter mechanism 320 is provided around the collection connection port 310.

<Tube-Side Collection Shutter Mechanism>

Here, as for the tube-side collection shutter mechanism 320, a tubular stopper 321 provided with a flange 322 is fitted in a slidable manner around the outer periphery of the collection transport tube 301, and a biasing spring 323 is interposed between the flange 322 of the tubular stopper 321 and the side wall of the cleaning container 36*a* such that the tubular stopper 321 closes the collection connection port 310 when the biasing spring 323 is naturally pulled.

—Side Cover—

Figure 4:
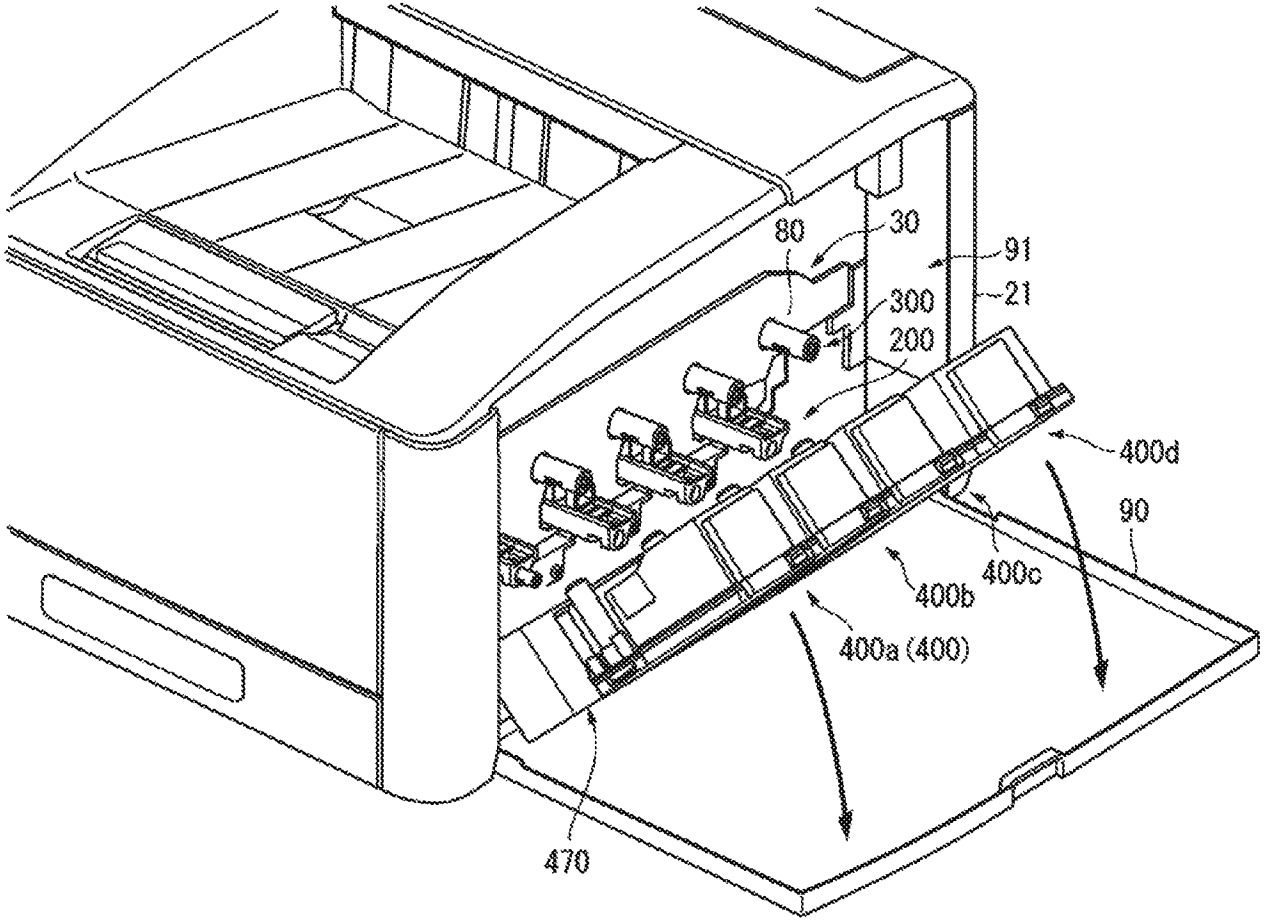
FIG. 4 is a view illustrating a positional relationship between toner cartridges and a side cover according to Exemplary Embodiment 1.
Figure 5:
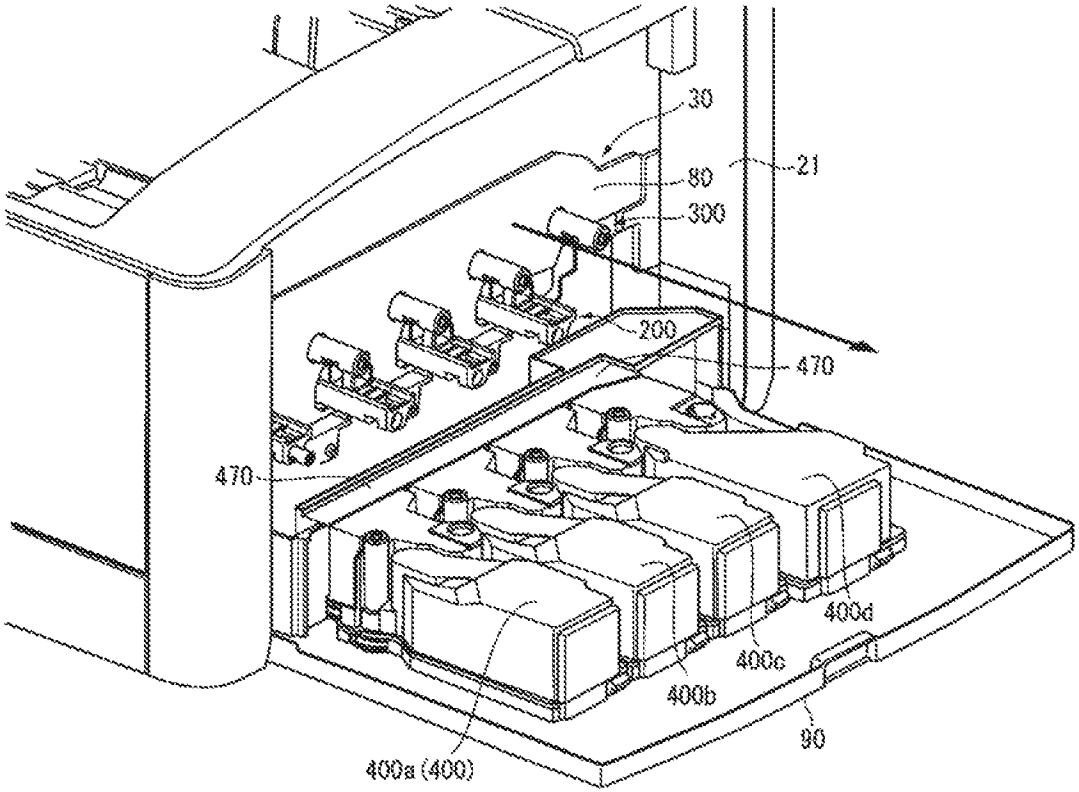
FIG. 5 is a view illustrating an example of an attachment and detachment operation of an image forming engine which is the processing engine when the opening and closing door is opened, in the image forming apparatus according to Exemplary Embodiment 1.
Figure 6:
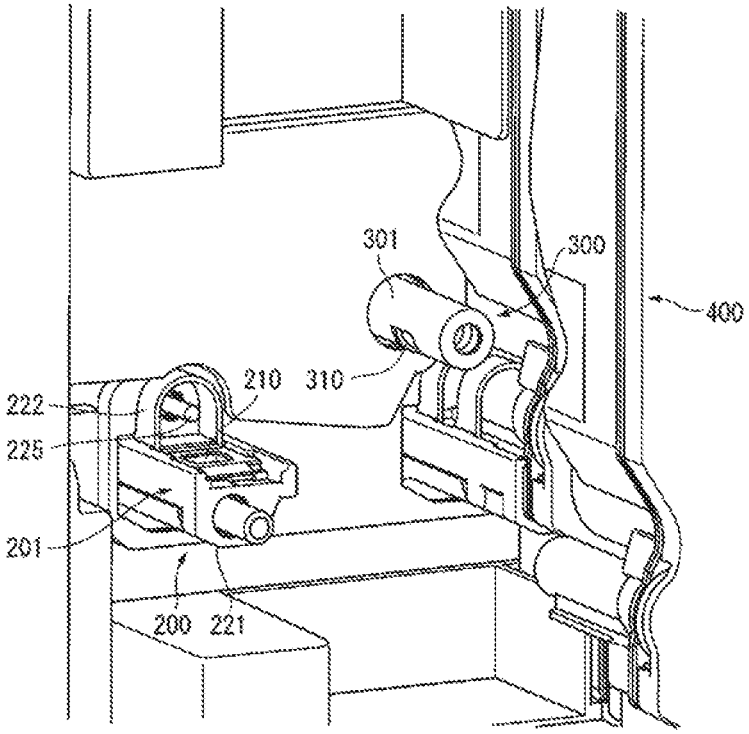
FIG. 6 is a view illustrating a portion of the image forming engine exposed to the side of the image forming unit when the side cover is opened.
Figure 11B:
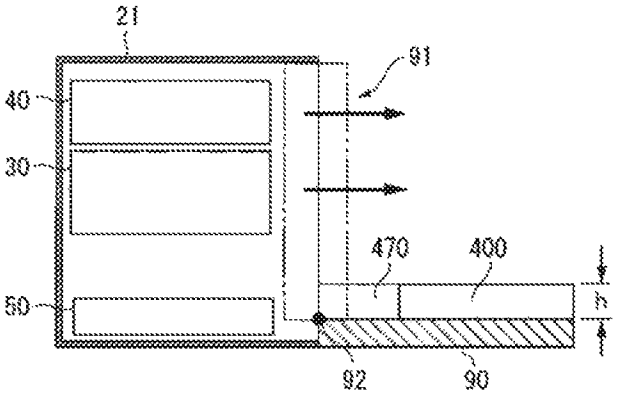
FIG. 11B is a view schematically illustrating a mounted state of the toner cartridge when the side cover is opened.
Figure 11A:
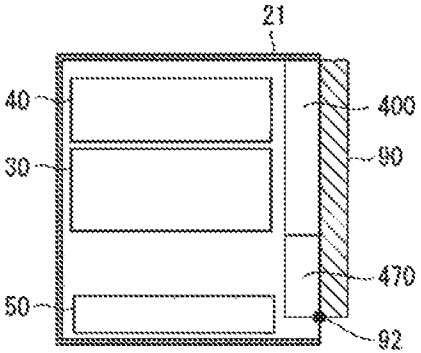
FIG. 11A is a view schematically illustrating a mounted state of the toner cartridge when the side cover is closed, in the image forming apparatus according to Exemplary Embodiment 1.

In the present exemplary embodiment, as illustrated in FIGS. 4 and 5, the apparatus housing 21 has an opening 91 in a side wall thereof in one of the rotation axis directions of the photoconductor 32 of each image forming unit 31 (31*a* to 31*d*), and is provided with an openable and closable side cover 90 that functions as an opening and closing door having a rotation fulcrum 92 at a lower edge portion of the opening 91 (see FIGS. 11A and 11B).

In the present example, the side cover 90 enables the insertion and extraction of the image forming engine 30, and the work for inserting and extracting the image forming engine 30 will be described later.

—Toner Cartridge—

In the present exemplary embodiment, as illustrated in FIGS. 4 and 5, toner cartridges 400 (specifically, 400*a* to 400*d*) are mounted in the apparatus housing 21, to replenish toners of the respective color components (yellow Y, magenta M, cyan C, and black K) and collect used waste toners. In the present example, the K toner cartridge 400*d* is molded to be bigger than the YMC toner cartridges 400*a* to 400*c*. However, the basic configurations of the toner cartridges are substantially similar to each other.

Figure 7:
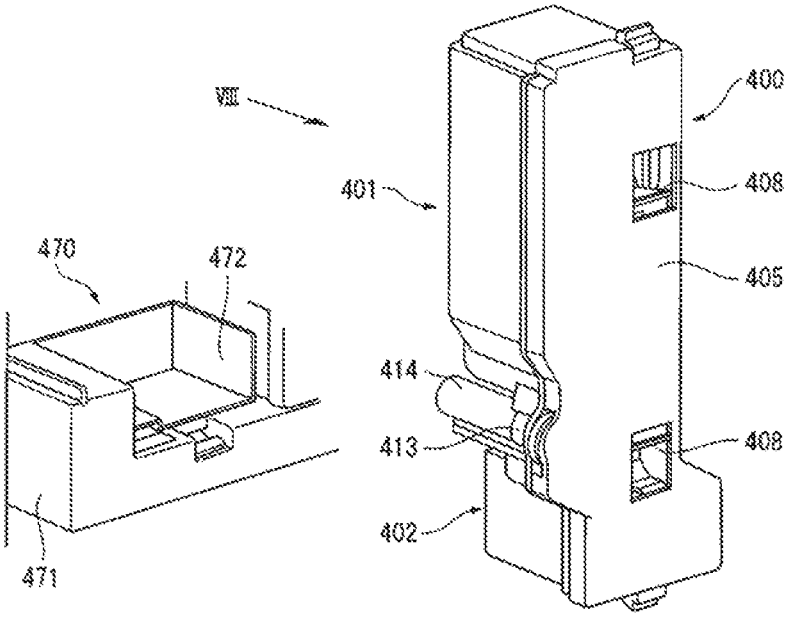
FIG. 7 is a view illustrating an example of a toner cartridge used in Exemplary Embodiment 1.
Figure 8B:
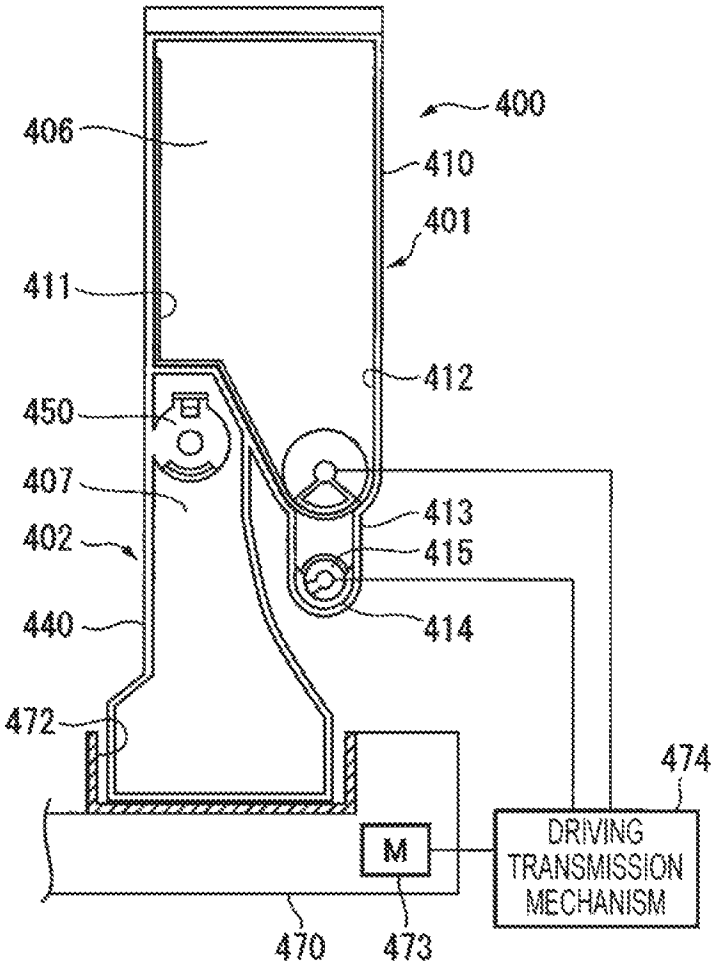
FIG. 8B is a view taken by cutting FIG. 8A along a line B-B.
Figure 8A:
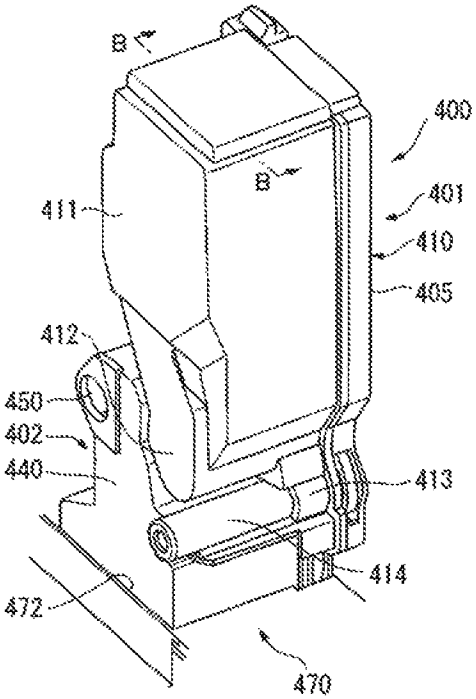
FIG. 8A is a view seen from the direction of an arrow VIII in FIG. 7.

In the present example, as illustrated in FIGS. 7, 8A and 8B, the toner cartridge 400 includes a toner replenishing unit 401 that replenishes new toner and a toner collection unit 402 that collects waste toner, in an integrated form. The toner cartridge 400 is assembled to a dispensing unit 470 that replenishes the replenished toner of the toner replenishing unit 401 in a fixed amount.

In the present example, the toner cartridge 400 and the dispensing unit 470 are mounted on the side of the side cover 90 and move along with the opening and closing of the side cover 90, as illustrated in FIGS. 4 and 5.

In the present example, the toner cartridge 400 includes a vertically long cartridge housing 405, and the cartridge housing 405 has two compartments 406 and 407 separated from each other in the vertical direction. A pair of handles 408 is provided in one side wall of the cartridge housing 405 to carry the toner cartridge 400.

<Toner Replenishing Unit>

In the present example, as illustrated in FIGS. 7 to 10B, the toner replenishing unit 401 uses the compartment 406 disposed in the upper portion of the cartridge housing 405 as the accommodating container 410 that accommodates new toner therein. In the accommodating container 410, a curved recess portion 412 that narrows downward is formed at the bottom of a substantially rectangular parallelepiped container body 411 along a predetermined direction (corresponding to the toner transport direction of the replenished toner transport unit 200), a connection tubular portion 413 is formed to extend downward from the bottom of the curved recess portion 412 on the side of one end thereof in the longitudinal direction (the back side away from the replenished toner transport unit 200), and a guide tubular portion 414 is formed at the lower portion of the connection tubular portion 413 to extend substantially in parallel with the curved recess portion 412 toward the replenished toner transport unit 200.

The curved recess portion 412 is provided with a delivery transport member 415 (an aspect where a spiral or paddle-shaped blade is attached to a rotation shaft, in the present example) that delivers the accommodated toner toward the connection tubular portion 413. The guide tubular portion 414 is provided with a guide transport member 416 (an aspect where a spiral blade is attached to a rotation shaft, in the present example) that replenishes the toner supplied from the connection tubular portion 413 in a fixed amount.

Further, a replenishment connected port 420 is formed in the bottom of the guide tubular portion 414 near the protruding end thereof, to be connected to the replenishment connection port 210 of the replenished toner transport unit 200, and a cartridge-side replenishment shutter mechanism 430 is provided around the replenishment connected port 420.

<Cartridge-Side Replenishment Shutter Mechanism>

In the present example, the cartridge-side replenishment shutter mechanism 430 includes a tubular stopper member 431 that is slidable along the longitudinal direction of the guide tubular portion 414, and a communication port 432 is formed in the stopper member 431 to correspond to the replenishment connected port 420. The stopper member 431 is movable between a closed position where the stopper member 431 is disposed at a deeper side than the replenishment connected port 420 such that the replenishment connected port 420 and the communication port 432 are deviated from each other and the replenishment connected port 420 is closed, and an opened position where the stopper member 431 is moved to a deeper side than the closed position while being pushed by the operation pin 225 of the tube-side replenishment shutter mechanism 220 such that the replenishment connected port 420 and the communication port 432 coincide with each other and the replenishment connected port 420 is opened.

The guide tubular portion 414 accommodates a holding spring 433 therein that applies a force for moving the stopper member 431 toward the closed position of the deeper side and holds the stopper member 431 at the closed position. In the present example, since the spring coefficient of the holding spring 433 is set to be larger than that of the biasing spring 223 of the tube-side replenishment shutter mechanism 220, the biasing spring 223 is elastically deformed first when the forces of the springs act.

<Toner Collection Unit>

In the present example, as illustrated in FIGS. 7 to 10B, the toner collection unit 402 is provided at the position that partially overlaps with the lower portion of the toner replenishing unit 401, and includes a collection container 440 that has a wide space below the toner replenishing unit 401. An insertion receiving unit 450 is provided on the upper portion of the collection container 440 to receive the insertion of the collection transport tube 301, and a cartridge-side collection shutter mechanism 460 is provided on the insertion receiving unit 450.

<Cartridge-Side Collection Shutter Mechanism>

Figure 10B:
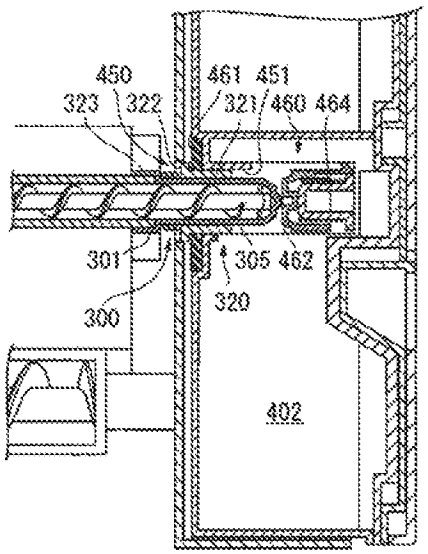
FIG. 10B is a view illustrating a state when the cleaning device and the toner collection unit are connected to each other.
Figure 10A:
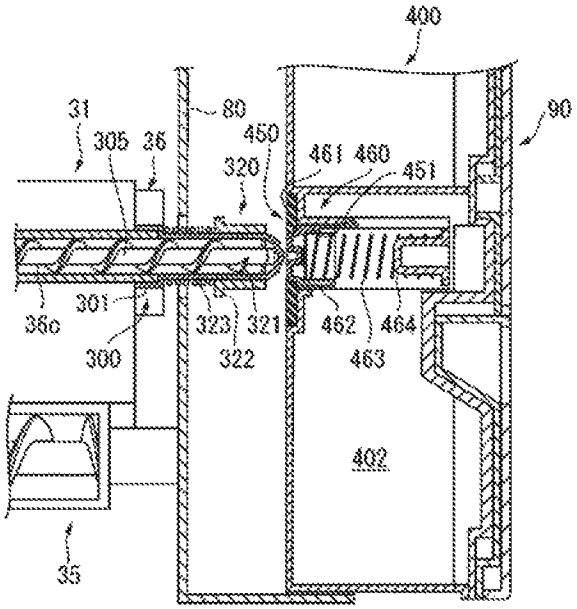
FIG. 10A is a view illustrating a state before a cleaning device of the image forming unit of the image forming engine and a toner collection unit of the toner cartridge are connected to each other.

Here, as for the cartridge-side collection shutter mechanism 460, as illustrated in FIGS. 10A and 10B, an elastic sealing member 461 is provided at the peripheral edge of an opening 451 of the insertion receiving unit 450, and a tubular stopper member 462 is disposed inside the insertion receiving unit 450 to close the opening 451. A biasing spring 463 is interposed between a holding pin 464 provided at the back side of the insertion receiving unit 450 and the stopper member 462, such that the opening 451 of the insertion receiving unit 450 of the collection container 440 is closed by the stopper member 462 that is pushed by the biasing spring 463 before the collection transport tube 301 is inserted into the insertion receiving unit 450.

—Dispensing Unit—

As illustrated in FIGS. 4, 7, 8A, and 8B, the dispensing unit 470 has a holding recess portion 472 that holds the lower portion of each toner cartridge 400 (400*a* to 400*d*), in a unit housing 471. A driving motor 473 and a driving transmission mechanism 474 such as a driving transmission gear train are mounted inside the unit housing 471.

As illustrated in FIGS. 9A and 9B, in the toner cartridge 400 (400*a* to 400*d*), driven transmission gears 417 and 418 are provided at one-side ends of the delivery transport member 415 and the guide transport member 416 of the toner replenishing unit 401 in the rotation axis direction. When the driving force of the driving motor 473 of the dispensing unit 470 is transmitted from the driving transmission mechanism 474 to the driven transmission gears 417 and 418 through a relay driving transmission mechanism (not illustrated), the delivery transport member 415 and the guide transport member 416 are driven.

At this time, the toner is replenished in a fixed amount by the delivery transport member 415 and the guide transport member 416, according to the number of rotations of the driving motor 473 of the dispensing unit 470, and a gear ratio of the driving transmission mechanism 474, the relay driving transmission mechanism, and the driven transmission gears 417 and 418.

In the present example, all of the components of the dispensing unit 470 are mounted on the side of the side cover 90. However, for example, all or a portion of the components of the dispensing unit 470 (the driving motor 473 or the driving transmission mechanism 474) may be mounted on the side of the apparatus housing 21, such that the driving force may be transmitted between the dispensing unit 470 and the toner cartridge 400 (400*a* to 400*d*) when the side cover 90 is closed.

—Operation of Image Forming Apparatus—

In the present exemplary embodiment, as illustrated in FIG. 2, when a user turns on a start switch (not illustrated) of the image forming apparatus 20, each image forming unit 31 (31*a* to 31*d*) of the image forming engine 30 performs a process of forming an image in each color component according to an image formation instruction from a control device (not illustrated). The formed image is transferred to the sheet S in the secondary transfer region by the intermediate transfer body 40, and the sheet S that has been subjected to the fixing process by the fixing device 70 is accommodated in the sheet accommodation tray 25.

At this time, in each image forming unit 31, the developing device 35 visualizes the electrostatic latent image on the photoconductor 32 with toner that is powder, and the cleaning device 36 cleans residual toner or the like on the photoconductor 32. Then, in the developing device 35, when the toner in the developing container 35*a* is insufficient, a control device (not illustrated) detects the insufficient state of toner, and the operation of replenishing toner from the toner replenishing unit 401 of the toner cartridge 400 is performed.

Meanwhile, in the cleaning device 36, when the residual toner or the like increases in the cleaning container 36*a*, a control device (not illustrated) detects whether the amount of residual toner in the cleaning container 36*a* exceeds a predetermined value (threshold value). Under a condition that the amount of residual toner exceeds the threshold value, the toner collection unit 402 of the toner cartridge 400 performs the toner collecting operation.

—Behaviors of Peripheries of Toner Cartridge When Side Cover is Opened and Closed—

<Behaviors of Peripheries of Toner Replenishing Unit>

FIG. 9A schematically illustrates the state around the toner replenishing unit 401 immediately before the side cover 90 is closed. FIG. 9B schematically illustrates the state around the toner replenishing unit 401 when the side cover 90 is closed.

In FIG. 9A, the replenishment connected port 420 of the guide tubular portion 414 of the toner replenishing unit 401 provided close to the toner cartridge 400 is deviated from the replenishment connection port 210 of the replenishment transport tube 201 of the replenished toner transport unit 200 provided close to the developing device 35. At this time, since the replenishment connected port 420 holds the stopper member 431 of the cartridge-side replenishment shutter mechanism 430 at the closed position, there is no concern that the replenished toner leaks from the replenishment connected port 420. Further, since the replenishment connection port 210 holds the lower tubular portion 221 of the tube-side replenishment shutter mechanism 220 at the closed position, there is no concern that the replenished toner leaks from the replenishment connection port 210.

Then, when the side cover 90 is further moved in the closing direction, the operation pin 225 of the tube-side replenishment shutter mechanism 220 abuts the stopper member 431 of the cartridge-side replenishment shutter mechanism 430, as illustrated in FIGS. 9A and 9B. In this state, since the spring coefficient of the biasing spring 223 of the tube-side replenishment shutter mechanism 220 is smaller than the spring coefficient of the holding spring 433 of the cartridge-side replenishment shutter mechanism 430, the operation pin 225 of the tube-side replenishment shutter mechanism 220 is pushed leftward in the drawing by the stopper member 431, and as a result, the upper tubular portion 222 moves leftward in the drawing in a state where the biasing spring 223 is compressed and deformed. Accordingly, the lower tubular portion 221 provided in the integrated form with the upper tubular portion 222 moves leftward in the drawing, and the tube-side replenishment shutter mechanism 220 is held at the opened position where the replenishment connection port 210 and the communication port 224 coincide with each other.

Meanwhile, when the lower tubular portion 221 reaches the opened position, the position of the operation pin 225 is fixed, and the stopper member 431 of the cartridge-side replenishment shutter mechanism 430 moves rightward in the drawing while compressing and deforming the holding spring 433 against the holding force of the holding spring 433, so as to be held at the opened position where the replenishment connected port 420 and the communication port 432 coincide with each other.

In this state, when the side cover 90 is closed, the replenishment connection port 210 of the replenishment transport tube 201 is disposed at the position that corresponds to the replenishment connected port 420 of the toner replenishing unit 401, so that the connection state between the replenishment connection port 210 and the replenishment connected port 420 is completed.

Accordingly, when the toner replenishing unit 401 of the toner cartridge 400 performs the operation of replenishing toner in a fixed amount from the dispensing unit 470, the toner in the guide tubular portion 414 is transported to the replenishment transport tube 201 through the replenishment connected port 420 and the replenishment connection port 210, and is replenished in a fixed amount to the developing container 35*a* by the toner transport member 205 inside the replenishment transport tube 201.

<Behaviors of Peripheries of Toner Collection Unit>

FIG. 10A schematically illustrates the state around the toner collection unit 402 immediately before the side cover 90 is closed. FIG. 10B schematically illustrates the state around the toner collection unit 402 when the side cover 90 is closed.

In FIG. 10A, in the toner collection unit 402 provided close to the toner cartridge 400, the opening 451 of the insertion receiving unit 450 of the collection container 440 is closed by the stopper member 462 pushed by the biasing spring 463 of the cartridge-side collection shutter mechanism 460. As a result, there is no concern that the collected toner leaks from the insertion receiving unit 450 of the collection container 440.

Further, the collection connection port 310 of the collection transport tube 301 on the side of the cleaning device 36 is closed by the tubular stopper 321 of the tube-side collection shutter mechanism 320. Thus, the collected toner does not leak from the collection connection port 310 of the collection transport tube 301.

Then, when the side cover 90 is further moved in the closing direction, the tubular stopper 321 of the tube-side collection shutter mechanism 320 is inserted into the insertion receiving unit 450 of the collection container 440, as illustrated in FIGS. 10A and 10B. At this time, the tubular stopper 321 abuts the stopper member 462 of the cartridge-side collection shutter mechanism 460, and retreats by a predetermined amount against the biasing force of the biasing spring 323. The tubular stopper 321 further pushes the stopper member 462 against the biasing force of the biasing spring 463, such that the flange 322 of the tubular stopper 321 reaches the state of being in close contact with the elastic sealing member 461.

In this state, the tubular stopper 321 relatively retreats from the closed position where the collection connection port 310 of the collection transport tube 301 is closed, so that the collection connection port 310 of the collection transport tube 301 is opened inside the collection container 440. Thus, residual toner or the like cleaned by the cleaning device 36 is transported by the toner transport member 305 in the collection transport tube 301, and collected from the collection connection port 310 into the collection container 440.

At this time, since the flange 322 of the tubular stopper 321 is in close contact with the elastic sealing member 461, there is no concern that the collected toner leaks from the edge of the opening 451 of the insertion receiving unit 450 of the collection container 440.

—Imaging Forming Engine Detaching Work—

Next, the work for detaching the image forming engine 30 will be described.

FIG. 11A illustrates a layout of the image forming engine 30, the intermediate transfer body 40, the sheet feeding device 50, the toner cartridge 400, and the dispensing unit 470 in the apparatus housing 21 when the side cover 90 is closed.

In the present example, the toner cartridge 400 and the dispensing unit 470 are mounted on the side of the side cover 90.

Thus, when the side cover 90 is opened about the rotation fulcrum 92 positioned at the lower edge portion of the opening 91 to be in a substantially horizontal posture, the toner cartridge 400 and the dispensing unit 470 move along with the opening operation of the side cover 90, as illustrated in FIG. 11B.

In this state, when the side cover 90 is opened, the toner cartridge 400 and the dispensing unit 470 are disposed on the side cover 90. Accordingly, the region of the opening 91 of the apparatus housing 21 becomes narrow by the thickness dimension "h" when the toner cartridge 400 and the dispensing unit 470 are arranged horizontally, but the region of the opening 91 that is not blocked by the toner cartridge 400 and the dispensing unit 470 is sufficiently wide. Thus, when the side cover 90 is opened, not only the image forming engine 30 but also the intermediate transfer body 40 may be inserted and extracted through the opening 91 of the apparatus housing 21.

In addition, in the work for inserting and extracting the image forming engine 30 or the intermediate transfer body 40, the image forming engine 30 or the intermediate transfer body 40 may be inserted and extracted along a guide rail (not illustrated) provided in advance inside the apparatus housing 21. Instead of providing the guide rail in the apparatus housing 21, the guide rail may be provided in, for example, a portion of the cartridge housing 405 of the toner cartridge 400.

(Comparative Exemplary Example 1)

Figure 12B:
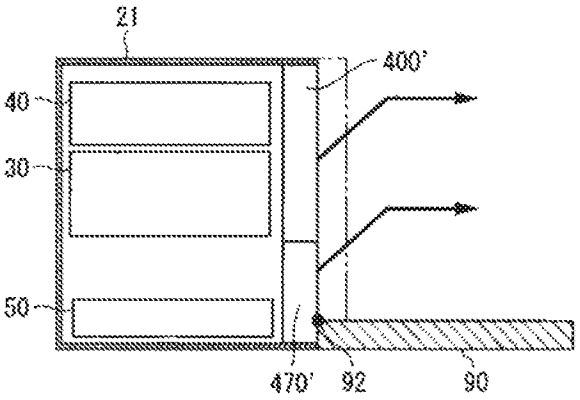
FIG. 12B is a view schematically illustrating a mounted state of the toner cartridge when the side cover is opened.
Figure 12A:
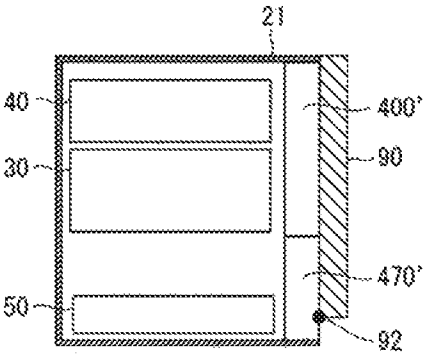
FIG. 12A is a view schematically illustrating a mounted state of a toner cartridge when a side cover is closed, in an image forming apparatus according to Comparative Example 1.

FIG. 12A illustrates a layout of the image forming engine 30 and others according to Comparative Exemplary Example 1.

FIG. 12A represents an example where a toner cartridge 400' and a dispensing unit 470' are provided on the bottom of the apparatus housing 21 that faces the side cover 90.

According to this example, as illustrated in FIG. 12B, even when the side cover 90 is opened, the toner cartridge 400' and the dispensing unit 470' are still disposed at the portion of the apparatus housing 21 that faces the opening 91. Thus, when the image forming engine 30 and others are inserted and extracted using the opening 91 of the apparatus housing 21, there is an inconvenience in that not only the toner cartridge 400' but also the dispensing unit 470' need to be first detached from the apparatus housing 21 in order to ensure the space for inserting and extracting the image forming engine 30.

—Example of Installation of Rotation Fulcrum of Side Cover—

Next, an example of the installation of the rotation fulcrum 92 of the side cover 90 will be described.

<Installation Example 1>

Figure 13B:
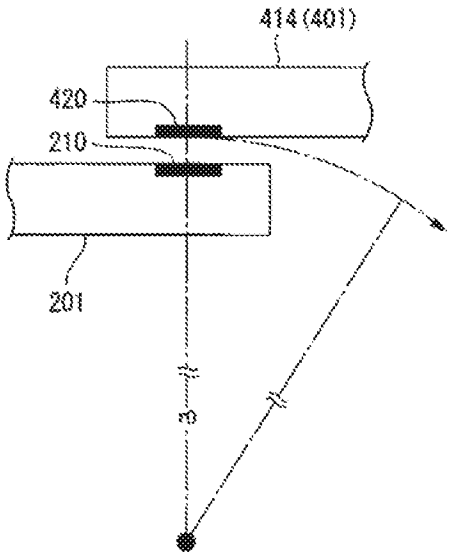
FIG. 13B is a view schematically illustrating a behavior of a toner replenishment unit of the toner cartridge when the side cover is opened.
Figure 13A:
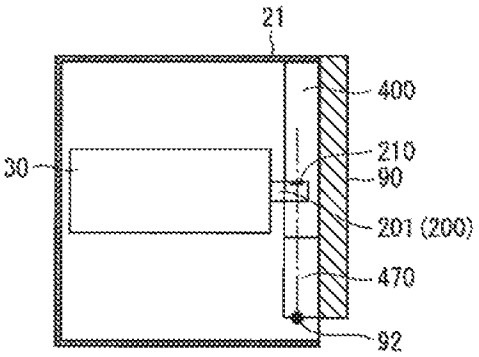
FIG. 13A is a view illustrating an aspect where a replenishment connection port for the developing device of the image forming unit of the image forming engine is positioned on a substantially vertical line to a rotation fulcrum of the side cover.

FIG. 13A represents an example where the replenishment connection port 210 of the replenishment transport tube 201 in the replenished toner transport unit 200 of the developing device 35 is disposed on the substantially vertical line to the rotation fulcrum 92 of the side cover 90.

In the present example, as illustrated in FIG. 13B, the rotation fulcrum 92 of the side cover 90, the center of the replenishment connection port 210 of the replenishment transport tube 201, and the center of the replenishment connected port 420 of the guide tubular portion 414 in the toner replenishing unit 401 of the toner cartridge 400 are arranged on the substantially vertical line. In consideration of the rotation trajectory of the replenishment connected port 420 of the guide tubular portion 414 accompanied by the opening and closing of the side cover 90, there is little concern that the guide tubular 414 and the replenishment transport tube 201 interfere with each other, even when the distance r0 between the rotation fulcrum 92 of the side cover 90 and the replenishment connected port 420 of the guide tubular portion 414 is set to be close to the distance between the rotation fulcrum 92 of the side cover 90 and the replenishment connection port 210 of the replenishment transport tube 201.

<Installation Example 2>

Figure 14C:
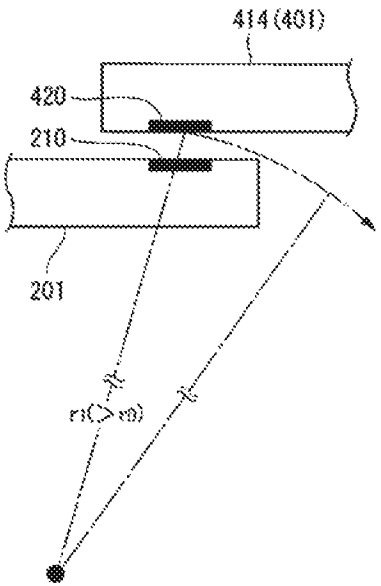
FIG. 14C is a view schematically illustrating a behavior of the toner replenishment unit of the toner cartridge when the side cover is opened, in the aspect illustrated in FIG. 14B.
Figure 14B:
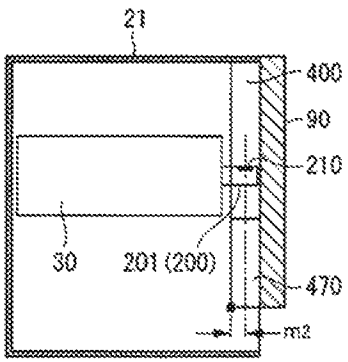
FIG. 14B is a view illustrating an aspect where the replenishment connection port for the developing device of the image forming unit of the image forming engine is positioned close to the side cover from the substantially vertical line to the rotation fulcrum of the side cover.
Figure 14A:
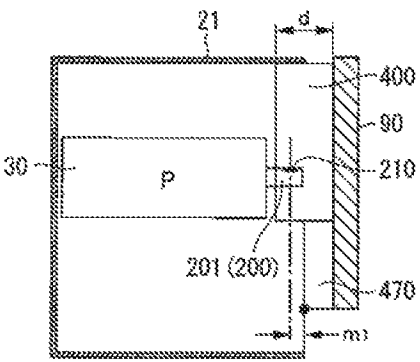
FIG. 14A is a view illustrating an aspect where the replenishment connection port for the developing device of the image forming unit of the image forming engine is positioned close to an apparatus housing from the substantially vertical line to the rotation fulcrum of the side cover.

FIG. 14A represents an example where the replenishment connection port 210 of the replenishment transport tube 201 in the replenished toner transport unit 200 of the developing device 35 is deviated by m1 toward the apparatus housing 21 from the substantially vertical line to the rotation fulcrum 92 of the side cover 90.

In this example, the thickness dimension "d" of the toner cartridge 400 in the left-and-right direction of the drawing needs to be set to be large, in order to implement the relationship between the toner replenishing unit 401 of the toner cartridge 400 and the replenishment transport tube 201 close to the developing device 35. As a result, the size of the toner cartridge 400 necessarily increases.

<Installation Example 3>

FIG. 14B represents an example where the replenishment connection port 210 of the replenishment transport tube 201 in the replenished toner transport unit 200 of the developing device 35 is deviated by m2 toward the side cover 90 from the substantially vertical line to the rotation fulcrum 92 of the side cover 90.

In this example, the rotation fulcrum 92 of the side cover 90, the center of the replenishment connection port 210 of the replenishment transport tube 201, and the center of the replenishment connected port 420 of the guide tubular portion 414 in the toner replenishing unit 401 of the toner cartridge 400 may not be arranged on the substantially vertical line. Thus, as illustrated in FIG. 14C, in consideration of the rotation trajectory of the replenishment connected port 420 of the guide tubular portion 414 accompanied by the opening and closing of the side cover 90, the distance r1 between the rotation fulcrum 92 of the side cover 90 and the replenishment connected port 420 of the guide tubular portion 414 needs to be set to be longer than the distance between the rotation fulcrum 92 of the side cover 90 and the replenishment connection port 210 of the replenishment transport tube 201, in order to avoid the interference between the guide tubular portion 414 and the replenishment transport tube 201.

The same applies to the layout between the rotation fulcrum 92 of the side cover 90 and the collection connection port 310 of the collection transport tube 301 in Installation Examples 1 to 3.

(Example of Modification)

In the present example, the toner cartridge 400 includes both the toner replenishing unit 401 and the toner collection unit 402. However, the present disclosure is not limited thereto, and the toner cartridge 400 may include one of the functional units.

In the present example, the plural image forming units 31 (31*a* to 31*d*) in the image forming engine 30 are arranged side by side in the substantially horizontal direction. However, the present disclosure is not limited thereto, and the plural image forming units 31 may be arranged along the substantially vertical direction. In this case, since the height dimension of the image forming engine 30 becomes larger than that in the aspect where the image forming units 31 are horizontally arranged, the height dimension of the apparatus housing 21 may increase when the rotation fulcrum 92 of the side cover 90 is disposed at the lower edge portion of the opening 91. Thus, in the image forming engine 30 provided with the vertically arranged image forming units 31, the side cover 90 may have the rotation fulcrum 92 at one-side edge thereof along the vertical direction of the opening 91, and the toner cartridge 400 and the dispensing unit 470 may be mounted on the corresponding side cover 90.

Exemplary Embodiment 2

Figure 15:
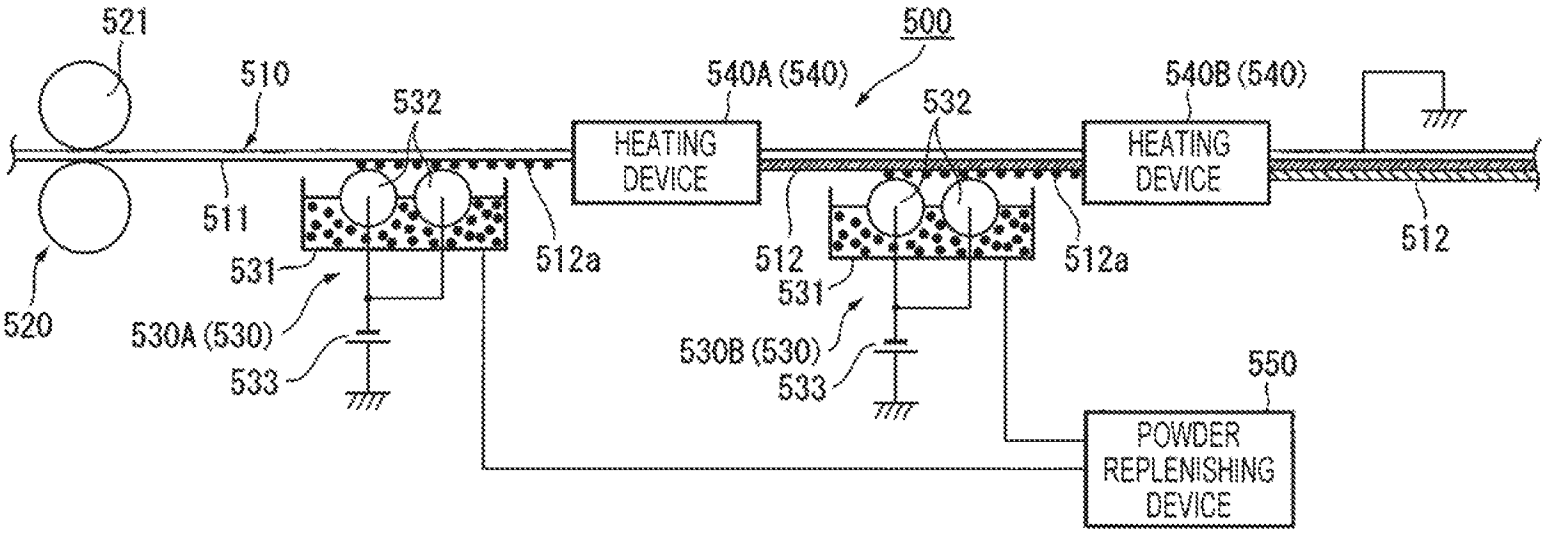
FIG. 15 is a view illustrating a powder coating apparatus which is a powder processing apparatus according to Exemplary Embodiment 2.

FIG. 15 illustrates a powder coating apparatus which is an example of the powder processing apparatus to which the present disclosure is applied.

In FIG. 15, a powder coating apparatus 500 includes a transport device 520 that transports, for example, a metal sheet 510 which is an object to be coated, one or plural coating units 530 (530A and 530B) (two coating units in the present example) that is arranged to face the coated surface 511 of the transported metal sheet 510 and coats the coated surface 511 of the metal sheet 510 with a charged thermosetting powder coating material 512, and one or plural heating devices 540 (540A and 540B) (two heating devices in the present example) that is provided on the side of the coating units 530 (530A and 530B) in the transport direction of the metal sheet 510, and heats and thermosets a powder particle layer 512*a* of the powder coating material 512 coated on the coated surface 511 of the metal sheet 510.

In this example, the powder coating material 512 may have the same color, or power coating materials in different colors may be coated over.

Further, when a detection element (not illustrated) detects a situation where the powder coating material in the coating unit 530 (530A and 530B) is insufficient, a powder replenishing device 550 supplies the powder coating material.

Here, the powder replenishing device 550 includes a powder cartridge that replenishes the powder coating material and a dispensing unit that replenishes the powder coating material in the powder cartridge in a fixed amount.

In this example, the metal sheet 510 is used as the object to be coated, and in order to electrostatically attach the powder coating material 512 to the coated surface 511 of the metal sheet 510, the metal sheet 510 is, for example, grounded (earthed). Alternatively, a voltage may be applied to the metal sheet 510 such that the metal sheet 510 has a polarity opposite to that of the charged powder coating material 512.

As for the transport device 520, a pair of transport rollers 521 that transports the metal sheet 510 by sandwiching the metal sheet 510 therebetween, or a transport belt (not illustrated) is used.

In the present example, the coating unit 530 includes a unit housing 531 that is opened facing the coated surface 511 of the metal sheet 510, the unit housing 531 accommodates therein the powder coating material 512 and a magnetic carrier (not illustrated) that charges the powder coating material 512, one or plural supply rollers 532 (two supply rollers in this example) are disposed facing the opening of the unit housing 531, and a power supply 533 is connected to each supply roller 532 to apply a coating voltage for forming a coating electric field between each supply roller 532 and the grounded metal sheet 510. As for the supply roller 532 of this example, a cylindrical or columnar magnet roller of which magnetic poles are alternately changed in the circumferential direction, or an aspect where a conductive sleeve is concentrically disposed on the external side of the magnet roller is used.

As for the heating device 540, any appropriate heating device may be selected as long as the heating device uses a known heat source such as a halogen lamp, a ceramic heater, an infrared lamp or the like.

According to the present exemplary embodiment, the powder coating material 512 from the coating unit 530 (530A and 530B) is coated on the coated surface 511 of the metal sheet 510, and the heating device 540 heats and thermosets the powder particle layer 512*a* of the powder coating material 512, so that the powder coating is completed.

Further, for the powder coating apparatus 500, a processing engine including necessary processing elements is detachably mounted in an apparatus housing (not illustrated). In this example, the apparatus housing (not illustrated) of the powder coating apparatus 500 is configured to have aside opening that is openable and closable by a side cover. The powder replenishing device 550 is mounted on the side cover, and is movable along with the opening and closing of the side cover.

Thus, when the same connection and disconnection structure as that in Exemplary Embodiment 1 is adopted for the powder replenishment path between the powder replenishing device 550 and the coating unit 530, it is possible to perform the operation of inserting and extracting the processing engine from the opening of the side cover when the side cover is opened.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A powder processing apparatus comprising:

a processing engine mounted inside an apparatus housing, the processing engine comprising one or a plurality of processing units each at least comprising a movable photoconductor that carries powder, and a developing device that supplies powder to the photoconductor;

a carrying region forming unit that forms a region on the photoconductor where powder can be carried;

an opening and closing door that opens and closes an opening about a rotation fulcrum, the opening being formed in a side wall of the apparatus housing disposed in one of directions intersecting a movement direction of the photoconductor; and toner cartridges that stores the powder to be used or already used in the processing units, the toner cartridges being provided on the opening and closing door so as to move along with the opening and closing of the opening and closing door, wherein when the opening and closing door is opened, an insertion and extraction path that is large enough to insert and extract the processing engine is ensured in the opening of the opening and closing door, excluding a region blocked by the toner cartridges that move along with the opening and closing door.

2. The powder processing apparatus according to claim 1, wherein in the processing engine, the plurality of processing units are arranged side by side in a substantially horizontal direction or a direction oblique to a horizontal direction.

3. The powder processing apparatus according to claim 2, wherein the processing engine is an image forming engine comprising one or a plurality of image forming units serving as the one or the plurality of processing units, each image forming unit at least comprising (i) an image carrier that serves as the photoconductor and carries an image, and (ii) a developing unit that serves as the developing device and visualizes the image carried on the image carrier with an image forming agent serving as the powder, and the carrying region forming unit is an image writing tool that writes an image on the image carrier.

4. The powder processing apparatus according to claim 1, wherein in the processing engine, all or a portion of the plurality of processing units arranged side by side is supported by a common engine frame.

5. The powder processing apparatus according to claim 4, wherein the processing engine is an image forming engine comprising one or a plurality of image forming units serving as the one or the plurality of processing units, each image forming unit at least comprising (i) an image carrier that serves as the photoconductor and carries an image, and (ii) a developing unit that serves as the developing device and visualizes the image carried on the image carrier with an image forming agent serving as the powder, and the carrying region forming unit is an image writing tool that writes an image on the image carrier.

6. The powder processing apparatus according to claim 1, wherein the toner cartridges comprise an accommodating container that accommodates the powder to be replenished to the processing units, and a fixed-amount replenishment mechanism that replenishes the powder accommodated in the accommodating container in a fixed amount.

7. The powder processing apparatus according to claim 6, wherein each processing unit of the processing engine comprises a transport tube for replenishment or collection of the powder, and a connection port at an end portion of the transport tube on the opening and closing door side, and the toner cartridges comprise a connected port that can be connected to or disconnected from the connection port of the transport tube along with the opening and closing of the opening and closing door.

8. The powder processing apparatus according to claim 7, wherein the connection port is provided in an upper or lower portion of the transport tube, and the connected port faces the connection port.

9. The powder processing apparatus according to claim 8, wherein the processing engine is an image forming engine comprising one or a plurality of image forming units serving as the one or the plurality of processing units, each image forming unit at least comprising (i) an image carrier that serves as the photoconductor and carries an image, and (ii) a developing unit that serves as the developing device and visualizes the image carried on the image carrier with an image forming agent serving as the powder, and the carrying region forming unit is an image writing tool that writes an image on the image carrier.

10. The powder processing apparatus according to claim 7, further comprising:

shutter mechanisms on the connection port and the connected port, respectively, the shutter mechanisms are opened when the connection port and the connected port are connected to each other, and the shutter mechanisms are closed when the connection port and the connected port are disconnected from each other.

11. The powder processing apparatus according to claim 10, wherein the processing engine is an image forming engine comprising one or a plurality of image forming units serving as the one or the plurality of processing units, each image forming unit at least comprising (i) an image carrier that serves as the photoconductor and carries an image, and (ii) a developing unit that serves as the developing device and visualizes the image carried on the image carrier with an image forming agent serving as the powder, and the carrying region forming unit is an image writing tool that writes an image on the image carrier.

12. The powder processing apparatus according to claim 7, wherein the processing engine is an image forming engine comprising one or a plurality of image forming units serving as the one or the plurality of processing units, each image forming unit at least comprising (i) an image carrier that serves as the photoconductor and carries an image, and (ii) a developing unit that serves as the developing device and visualizes the image carried on the image carrier with an image forming agent serving as the powder, and the carrying region forming unit is an image writing tool that writes an image on the image carrier.

13. The powder processing apparatus according to claim 6, wherein the processing engine is an image forming engine comprising one or a plurality of image forming units serving as the one or the plurality of processing units, each image forming unit at least comprising (i) an image carrier that serves as the photoconductor and carries an image, and (ii) a developing unit that serves as the developing device and visualizes the image carried on the image carrier with an image forming agent serving as the powder, and the carrying region forming unit is an image writing tool that writes an image on the image carrier.

14. The powder processing apparatus according to claim 1, wherein the toner cartridges comprise a collection container that collects the powder already used in the developing device.

15. The powder processing apparatus according to claim 14, wherein the processing engine is an image forming engine comprising one or a plurality of image forming units serving as the one or the plurality of processing units, each image forming unit at least comprising (i) an image carrier that serves as the photoconductor and carries an image, and (ii) a developing unit that serves as the developing device and visualizes the image carried on the image carrier with an image forming agent serving as the powder, and the carrying region forming unit is an image writing tool that writes an image on the image carrier.

16. The powder processing apparatus according to claim 1, wherein the opening and closing door has the rotation fulcrum at a lower edge portion of the opening of the apparatus housing.

17. The powder processing apparatus according to claim 16, wherein each processing unit of the processing engine comprises a transport tube for replenishment or collection of the powder, and a connection port at an end portion of the transport tube on the opening and closing door side, and the rotation fulcrum of the opening and closing door is positioned on a substantially vertical line to the connection port.

18. The powder processing apparatus according to claim 16, wherein the processing engine is an image forming engine comprising one or a plurality of image forming units serving as the one or the plurality of processing units, each image forming unit at least comprising (i) an image carrier that serves as the photoconductor and carries an image, and (ii) a developing unit that serves as the developing device and visualizes the image carried on the image carrier with an image forming agent serving as the powder, and the carrying region forming unit is an image writing tool that writes an image on the image carrier.

19. The powder processing apparatus according to claim 1, wherein the processing engine is an image forming engine comprising one or a plurality of image forming units serving as the one or the plurality of processing units, each image forming unit at least comprising (i) an image carrier that serves as the photoconductor and carries an image, and (ii) a developing unit that serves as the developing device and visualizes the image carried on the image carrier with an image forming agent serving as the powder, and the carrying region forming unit is an image writing tool that writes an image on the image carrier.

20. The powder processing apparatus according to claim 19, further comprising:

an intermediate transfer unit above the image forming engine, wherein the intermediate transfer unit and the image forming engine can be separately inserted and extracted through the opening of the opening and closing door.

* * * * *